United States Patent [19]

Kolb

[11] 3,991,945

[45] Nov. 16, 1976

[54] CENTRIFUGAL MILL

[75] Inventor: Lothar Kolb, Alpenrod, Westerwald, Germany

[73] Assignee: Gebr. Klockner KG, Alpenrod, Westerwald, Germany

[22] Filed: Dec. 18, 1974

[21] Appl. No.: 534,103

[52] U.S. Cl. ..... 241/55; 241/163; 241/244

[51] Int. Cl.[2] ..... B02C 23/28

[58] Field of Search ..... 241/52, 55, 56, 154, 241/163, 28, 29, 54, 58, 59, 244, 245, 260, 260.1, 260.2, 260.3

[56] References Cited

FOREIGN PATENTS OR APPLICATIONS 95,480 7/1922 Switzerland ..... 241/56

351,281 7/1931 United Kingdom ..... 241/56

*Primary Examiner*—Granville Y. Custer, Jr.

*Attorney, Agent, or Firm*—Fred Philpitt

[57] ABSTRACT

A centrifugal mill for disintegrating fibrous material is provided with a cylindrical grinding track in front of a conical grinding track. The grinding tracks are corrugated and are adapted to cooperate with rotary grinding blades. The corrugation of the cylindrical track is coarse compared to that of the conical grinding track. The charging port of the mill is arranged at the larger cone diameter and the discharging port for the ground stock is arranged at the smaller cone diameter. Means are provided for conducting a controlled air flow from the larger cone diameter to the smaller one through regular spaces between the rotary grinding blades in the peripheral direction thereof.

3 Claims, 3 Drawing Figures

CENTRIFUGAL MILL

PRIOR ART

Figure 2:
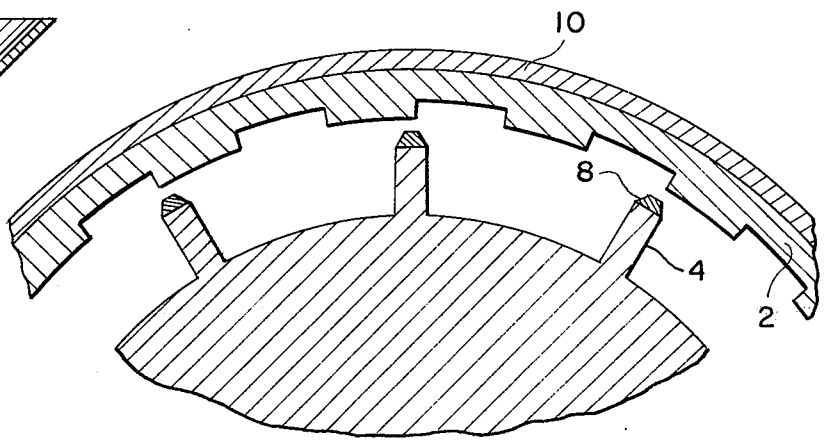

In most mills for these purposes, the desired final size of grain or of the fibrous parts is determined by built-in sieves. The material is disintegrated in an impact grinding track. The fine material is carried to one side or to both sides by an air flow and is flung through sieves installed beside the grinding track. Such mills suffer from sieve abrasion and from the additional drawbacks that in working wood or wood-containing material, only short fibers can be disintegrated and that the sieves become stopped up by wet grinding stock. However, the fibers of wooden parts tend to be longer the wetter they are ground.

Another sort of mill or refining machine is equipped with two corrugated disks or cone disks between which the grinding stock is ground or finished in a narrow gap. The desired fineness is controlled by adjusting the disk spacing at the circumference. This requires an extreme accuracy since tiny fractions of a millimeter or a few mils must be reckoned with. Due to these exacting conditions, such machines are very expensive. Therefore, they are employed by the wood pulp and paper industries only, and the grinding stock is soaked and swelled by vapor or water prior to grinding.

Further conventional cone mills and cone refining machines operate in such a way that the grinding stock is transported from the smaller cone diameter to the larger one. Numerous types of mills feature built-in sifting means which, however, hitherto required considerable efforts regarding design and manufacturing methods. Sifting or adjusting the grain fineness is impossible with cone mills wherein the grinding stock travels from the smaller to the larger cone diameter, as the material follows the centrifugal force throughout the mill so that coarse particles pass far too fast.

OBJECTS OF THE INVENTION

It is an important object of the present invention to eliminate the disadvantages of the prior art and to develop simple economical means for disintegrating various materials into fine stock. It is another object of the invention to provide a centrifugal mill feeding the material to be ground back to the charging port until the particles are fine enough to be discharged. A further object of the invention consists in providing a centrifugal mill of rugged construction having convenient controls for obtaining fine material of adjustable grain size.

BRIEF SUMMARY OF THE INVENTION

The centrifugal mill according to the invention comprises a conical grinding track that is corrugated inside, rotatory grinding blades between which there are regular spaces in the peripheral direction and means for conducting controlled air flow through the spaces between said rotatory grinding blades from the larger cone diameter to the smaller one, the charging port of the mill being arranged at the larger cone diameter and the discharging port for the ground stock being arranged at the smaller cone diameter.

Due to this simple and efficient design, there is a steady feedback of the coarse material to be ground from the grinding track to the charging port where the air flow carries it inside towards the grinding track, the process continuing down to a degree of fineness enabling transportation of the particles between the rotatory blade spaces towards the discharging port. By controlling the air flow, it is easily possible to adjust the final grain size. It may be desirable to improve a centrifugal mill according to the invention by arranging a cylindrical grinding track in front of the conical one. In such a case it is expedient to provide the cylindrical grinding track with a corrugation that is much coarser than that of the conical grinding track opposite which there is preferably a larger number of light-weight rotatory grinding blades, whereas a smaller number of heavy rotatory grinding blades is arranged opposite said cylindrical grinding track. Consequently, the latter acts as a supplementary grinding track for coarse particles which are carried on, by the air flow, to the conical grinding track only when an adjustable degree of fineness is reached whereupon the final grinding will take place there.

The invention further provides rotatory grinding blades comprising hard metal plates at their peripheral ends onto which said hard metal plates are preferably welded.

It will be seen that a particular advantage of the invention results from the fact that the final grain size may be most simply controlled by varying the air flow through the mill, e.g. by means of an exhaustor having a control flap arranged downstream of the mill. Thus it is possible to draw air off either through the mill or, in addition, from the environment, reducing the airflow in the mill. While a strong air flow will sweep coarse particles along despite the centrifugal force in the conical grinding track so that the ground material is relatively coarse, a weak air flow transports only finely divided material, the coarser particles being constantly returned to the conical grinding track due to the centrifugal force. Thus very fine ground stock is obtained if the air flow is throttled or otherwise reduced.

BRIEF FIGURE DESCRIPTION

Figure 3:
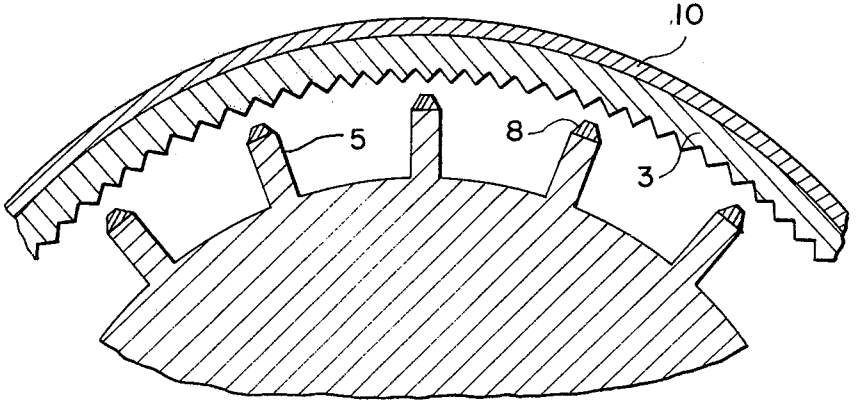
Figure 1:
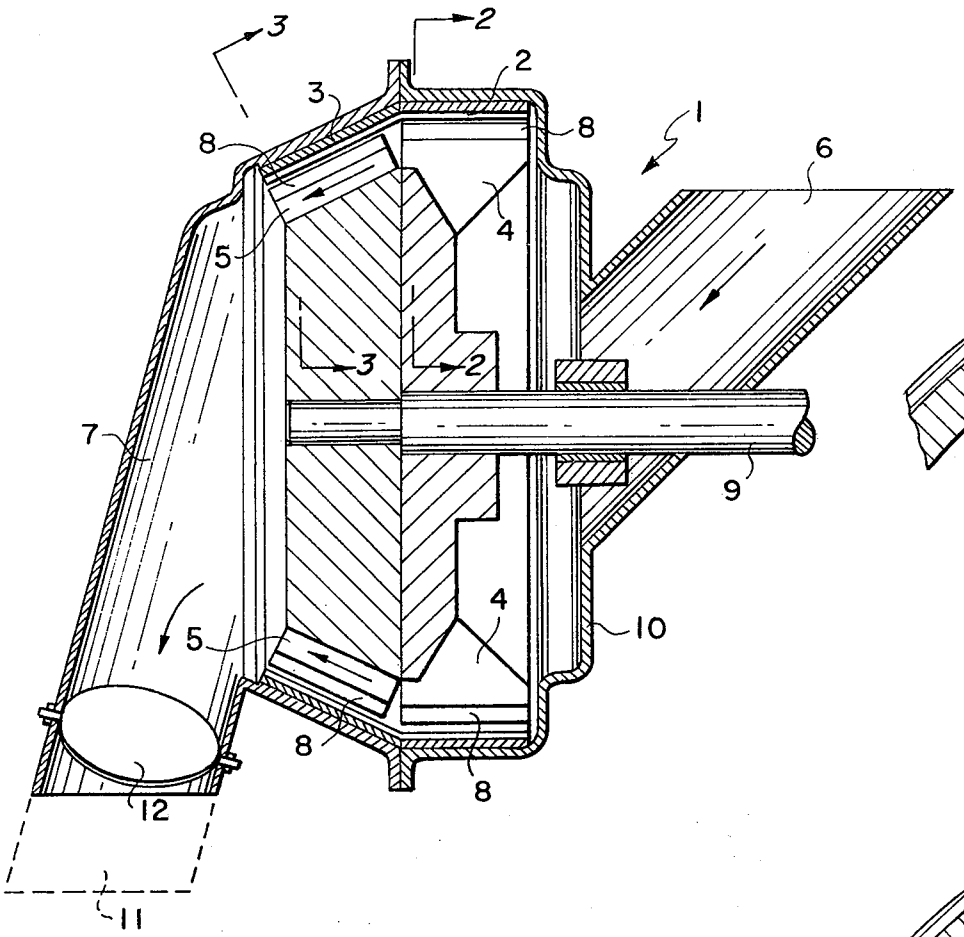

Further objects, features and advantages of the invention will become evident from the following description of preferred embodiments taken in connection with the accompanying drawings in which:

FIG. 1 is a longitudinal section view schematically showing a centrifugal mill according to the invention, FIG. 2 is part of a cross section through 2—2 of a cylindrical grinding track of a mill according to FIG. 1, and FIG. 3 is part of a cross section through 3—3 of a conical grinding track of a mill according to FIG. 1.

DETAILED SPECIFICATION

In the longitudinal section view along the mill axis, FIG. 1 shows a centrifugal mill 1 having a cylindrical grinding track 2 and an adjacent conical grinding track 3. Heavy rotatory grinding blades 4 rotate opposite the cylindrical grinding track 2. Light-weight rotatory grinding blades 5 are rotatably arranged opposite the conical grinding track 3. A charging port 6 is at the side of the cylindrical grinding track 2, whereas a discharging port 7 is arranged at the smaller cone diameter at the side of the conical grinding track 3. FIG. 2 shows the coarsely corrugated cylindrical grinding track 2 and an exemplary heavy grinding blade 4. From FIG. 3, the finely corrugated conical grinding track 3 with three exemplary grinding light-weight blades 5 is evident. The charging port 6 and the discharging port 7 may be attached in any known manner.

The rotatory grinding blades 4 and 5, respectively, are provided with hard metal plates 8 welded thereon. The centrifugal mill 1 is driven by means of a shaft 9 that is connected to a motor or a gear (not shown). The grinding tracks 2 and 3 are enclosed by a case or housing 10 to which the charging and discharging ports 6 and 7 are connected, respectively. In the embodiment of FIG. 1, both charging port 6 and discharging port 7 are arranged at an angle to the axis of rotation, i.e. to the shaft 9. The corrugations of the grinding tracks 2 and 3 may be straight, viz. essentially transverse to the periphery at a constant angle to the axis of rotation; however, the invention also contemplates threading or inclined corrugations. In order to generate an air flow, suitable compressed air or suction air units may be arranged upstream of the charging port 6 and/or downstream of the discharging port 7. Preferably, an exhaustor 11 having a throttle or control flap 12 is connected to the disc having port 7.

The material to be ground, e.g. wood chippings, plastics wastes, etc., travels inside the centrifugal mill 1 from the coarsely corrugated cylindrical grinding track 2 to the more finely corrugated conical grinding track 3. Since the grinding stock is moved from the larger to the smaller cone diameter, coarse particles are stopped due to the acting centrifugal force, while fine particles are raised by the air flow in the spaces between each of the grinding blades 4 and 5, respectively, and are drawn off subsequently. If the air flow is weak, only finely divided material is discharged. A stronger air flow carries coarser particles along despite the centrifugal force, discharging them from the mill 1.

The arrangement and types of structural components utilized within this invention may be subject to numerous modifications well within the purview of the invention and applicant intends only to be limited to a liberal interpretation of the specification and appended claims.

I claim:

1. A centrifugal mill for disintegrating fibrous material such as wood chips, wood shavings and the like, which comprises in combination:

a. a cylindrical grinding track, having corrugations around the interior of its periphery, b. a conical grinding track positioned immediately adjacent to said cylindrical grinding track, said conical grinding track having corrugations around the interior of its periphery, c. the corrugations of said cylindrical track being coarse compared to the corrugations of said conical grinding track, d. rotary grinding means located interior of both said cylindrical grinding track and said conical grinding track, said rotary grinding means including two sets of outwardly extending grinding blades that are adapted to cooperate with said grinding tracks to thereby disintegrate fibrous material, e. a charging port for feeding fibrous material to the area between said cylindrical grinding track and the rotary grinding blades located interiorly thereof, and f. a discharge port positioned adjacent to said conical grinding track for discharging disintegrated fibrous material from the centrifugal mill.

2. A centrifugal mill according to claim 1 which includes an air flow control means positioned in said discharge port.

3. A centrifugal mill according to claim 2 wherein said air control means comprises an adjustable flap mounted in said discharge port.

* * * * *